US006568127B1

(12) United States Patent
Kalman et al.

(10) Patent No.: US 6,568,127 B1
(45) Date of Patent: May 27, 2003

(54) TREE STAND WITH LIQUID RESERVOIR

(75) Inventors: Jeffrey Kalman, Cleveland Heights, OH (US); John W. Spirk, Gates Mills, OH (US); Dale A. Panasewicz, Strongsville, OH (US); Marc Louis Vitantonio, Sr., South Russell, OH (US); John R. Nottingham, Hunting Valley, OH (US)

(73) Assignee: Emerald Innovations, L.L.C., Cleveland, OH (US)

( * ) Notice: Subject to any disclaimer, the term of this patent is extended or adjusted under 35 U.S.C. 154(b) by 0 days.

(21) Appl. No.: 10/000,046

(22) Filed: Oct. 18, 2001

Related U.S. Application Data

(60) Provisional application No. 60/242,084, filed on Oct. 20, 2000, and provisional application No. 60/250,603, filed on Dec. 1, 2000.

(51) Int. Cl.[7] ..... A47G 33/12
(52) U.S. Cl. ..... 47/40.5
(58) Field of Search ..... 47/40.5; 248/519, 248/523, 516, 524; 137/614.04

(56) References Cited

U.S. PATENT DOCUMENTS 3,137,969 A 6/1964 Sokol ..... 47/57.5
3,469,342 A * 9/1969 Morris ..... 248/188.7
3,542,069 A * 11/1970 Ollison ..... 119/51.15
4,829,708 A * 5/1989 Gonzalez ..... 222/457
5,201,140 A * 4/1993 Voorhis ..... 47/40.5
5,669,178 A 9/1997 Petrovic ..... 47/40.5
5,987,813 A 11/1999 Lasko ..... 47/40.5

* cited by examiner

*Primary Examiner*—Peter M. Poon
*Assistant Examiner*—Son T. Nguyen
(74) *Attorney, Agent, or Firm*—Calfee, Halter & Griswold LLP

(57) ABSTRACT

A tree stand for supporting a tree includes a base. The base includes a receptacle for receiving and supporting the trunk of the tree. A fluid reservoir for storing a fluid is detachably connected to the base. A first valve is attached to the reservoir and is operable between and open and closed position to allow fluid to flow outwardly of the reservoir in the open position and to prevent fluid from flowing outwardly of the reservoir in the closed position. A second valve is attached to the base and is in fluid communication with the receptacle. The second valve is operable in an open position to allow fluid to flow into the receptacle, and a closed position to prevent fluid from flowing outwardly of the receptacle. The first and second valves are disposed such that when the fluid reservoir is attached to the base, the first valve engages the second valve to cause the first valve to move from the closed position to the open position and allow the second valve to move from the closed position to the open position thereby allowing fluid to flow from the fluid reservoir into the receptacle.

5 Claims, 5 Drawing Sheets

TREE STAND WITH LIQUID RESERVOIR

PRIORITY CLAIM

This application claims the benefit of U.S. Provisional Patent Application No. 60/242,084, filed on Oct. 20, 2000, and entitled "Christmas Tree Stand with Reservoir" and claims the benefit of U.S. Provisional Patent Application No. 60/250,603, filed on Dec. 1, 2000, and entitled "Christmas Tree Stand with Reservoir".

TECHNICAL FIELD OF THE INVENTION

The present invention relates to tree stands, and more particularly to a tree stand having a fluid reservoir.

BACKGROUND OF THE INVENTION

It is desirable to keep live cut Christmas trees as fresh as possible during the season while such trees are displayed indoors. These trees require water as soon as possible, as they are often cut and stored for a period of time prior to purchase by a consumer. It is important for fire and other reasons to provide water directly to the base of the tree, and maintain the tree supplied with water. In many instances, it is difficult to gain access to the base of the tree to add water to a receptacle supporting the tree base without disturbing the tree or inconveniencing the person adding water to the tree receptacle.

A need has thus arisen for a tree stand reservoir for adding water continuously to a tree base receptacle from a reservoir which can be remotely filled and which is attached to the tree stand and which further prevents water within the reservoir and within the stand from leaking when the reservoir is detached.

SUMMARY OF THE INVENTION

In accordance with the present invention, a tree stand for supporting a tree is provided. The tree stand includes a base. The base includes a receptacle for receiving and supporting the trunk of the tree. A fluid reservoir for storing a fluid is detachably connected to the base. A first valve is attached to the reservoir and is operable between and open and closed position to allow fluid to flow outwardly of the reservoir in the open position and to prevent fluid from flowing outwardly of the reservoir in the closed position. A second valve is attached to the base and is in fluid communication with the receptacle. The second valve is operable in an open position to allow fluid to flow into the receptacle, and a closed position to prevent fluid from flowing outwardly of the receptacle. The first and second valves are disposed such that when the fluid reservoir is attached to the base, the first valve engages the second valve to cause the first valve to move from the closed position to the open position and allow the second valve to move from the closed position to the open position thereby allowing fluid to flow from the fluid reservoir into the receptacle.

BRIEF DESCRIPTION OF THE DRAWINGS

For a more complete understanding of the present invention and for further advantages thereof, reference is now made to the following Description of the Preferred Embodiments taken in conjunction with the accompanying drawings in which.

DESCRIPTION OF THE PREFERRED EMBODIMENT

Figure 1:
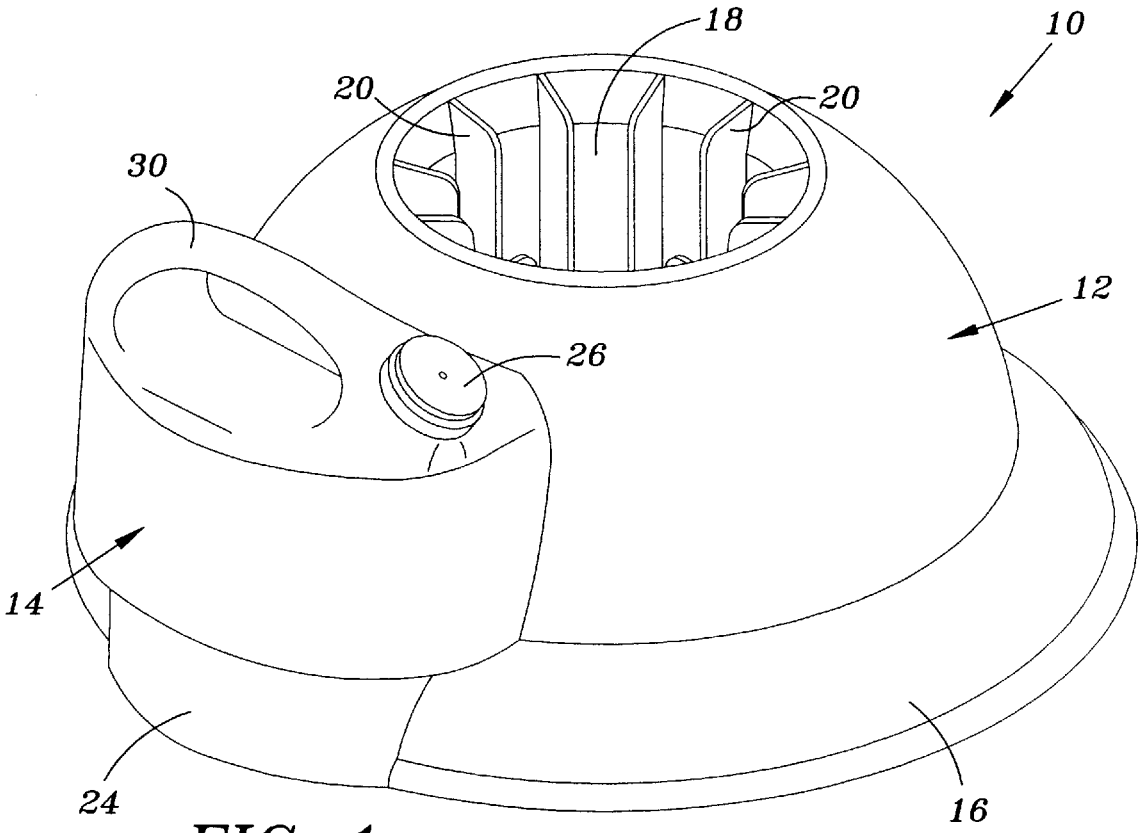
FIG. 1 is a perspective view of the present tree stand and liquid reservoir.
Figure 2:
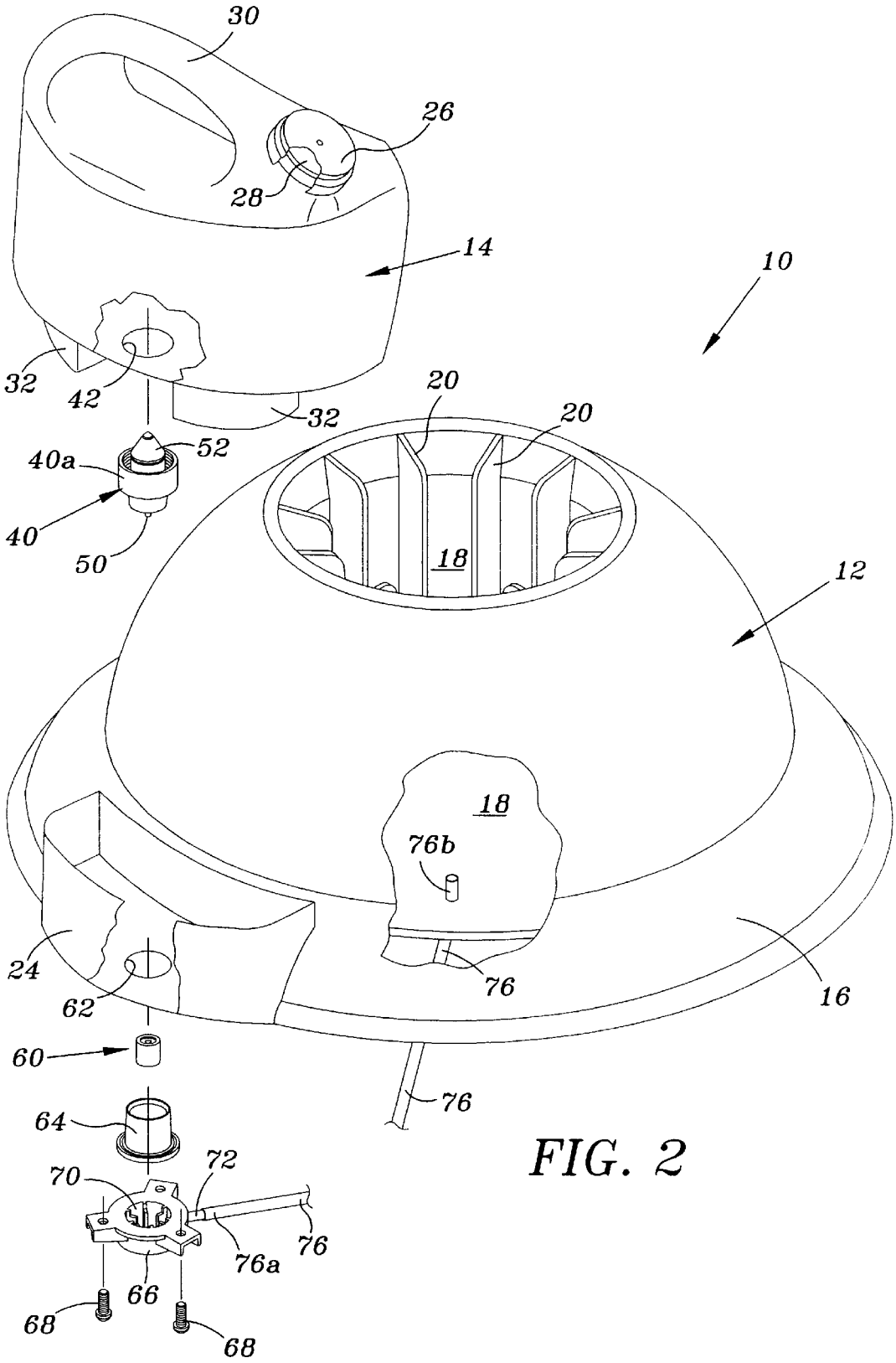
FIG. 2 is an exploded perspective view of the present tree stand and liquid reservoir shown in FIG. 1.

Referring simultaneously to FIGS. 1 and 2, the present tree stand with liquid reservoir is illustrated, and is generally identified by the numeral 10. Tree stand with liquid reservoir 10 includes a stand, generally identified by the numeral 12, and a liquid reservoir, generally identified by the numeral 14. Reservoir 14 provides a continuous source of fluid, such as for example, water to a tree supported within stand 12.

Stand 12 includes a base 16. Base 16 includes a receptacle 18 for receiving and supporting the trunk of a tree (not shown). Receptacle 18 holds a supply of water which is supplied to the trunk of the tree. Receptacle 18 includes fins 20 for engaging the trunk of the tree, and thereby maintain the tree in a secure position. Fins 20 are shown for illustrative purposes only, it being understood that various other mechanical fastening devices may be utilized with stand 12 to securely and properly position the tree within stand 12.

Reservoir 14 is detachably mounted to base 16 within a holder 24. Reservoir 14 provides water on a continuous basis to receptacle 18 of stand 12. When empty reservoir 14 may be refilled while positioned within holder 24, or, more conveniently, refilled from a water source located remote from stand 12. Reservoir 14 is provided with a fill cap 26 for closing an aperture 28. Aperture 28 provides an opening within reservoir 14, such that reservoir 14 may be refilled with a liquid. Reservoir 14 further includes a handle 30 to provide a convenient mechanism for a user to transport reservoir 14 between stand 12 and a water source. Reservoir 14 further includes a pair of feet 32 which engage holder 24 for maintaining reservoir 14 securely fastened to base 16 of stand 12.

Figure 3:
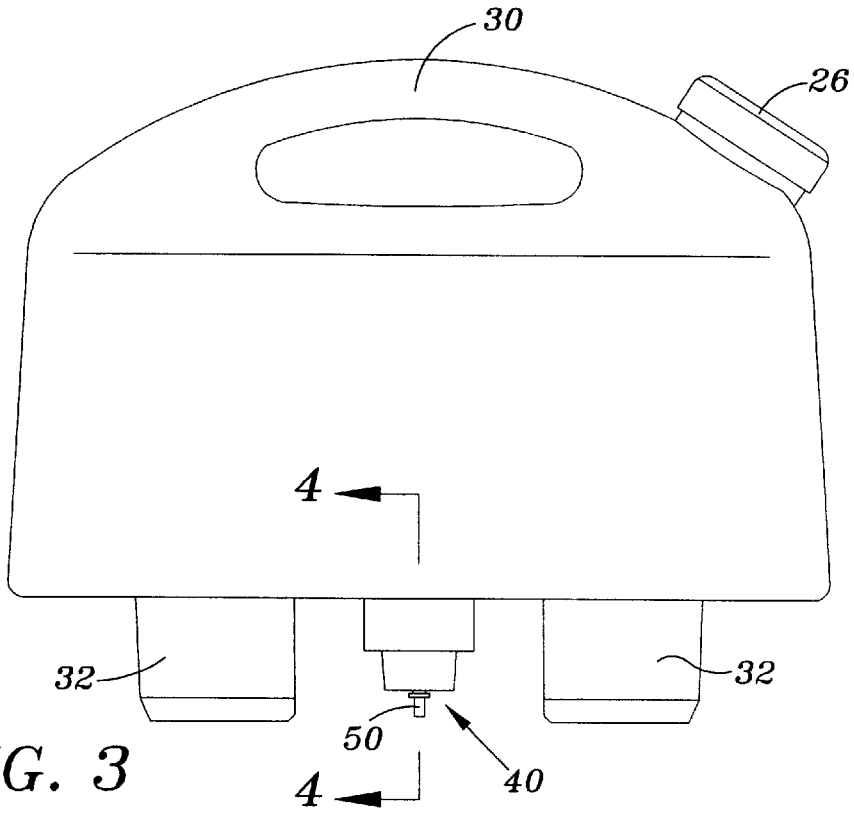
FIG. 3 is a side elevational view of the present liquid reservoir.

Referring simultaneously to FIGS. 2 and 3, reservoir 14 includes a reservoir valve, generally identified by the numeral 40. Reservoir valve 40 includes a cap 40*a* which is threadedly engaged to an aperture 42 contained within reservoir 14. Valve 40 is operable between an open position and a closed position. In the closed position, valve 40 prevents water from flowing outwardly of reservoir 14. In the valve open position, fluid flows outwardly of reservoir 14. Valve 40 is normally in the closed position to prevent water from flowing outwardly of reservoir 14 while reservoir 14 is being filled, transported to base 16, and prior to insertion of reservoir 14 into holder 24. In accordance with the present invention, valve 40 operates in the open position only when reservoir 14 is fully inserted within holder 24.

Figure 4:
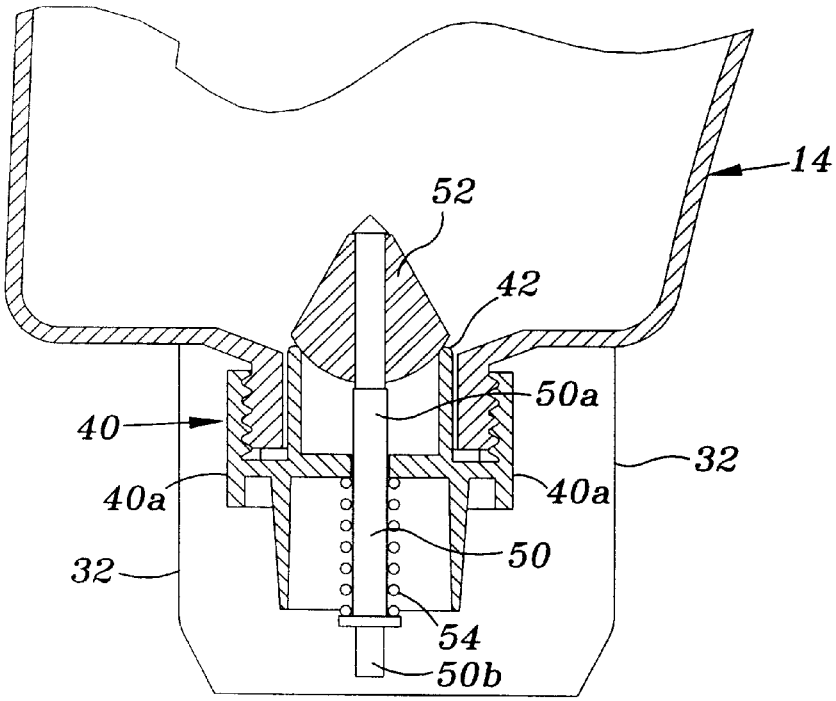
FIG. 4 is a sectional view taken generally along sectional lines 4—4 of FIG. 3 of the present reservoir valve in the closed position.
Figure 5:
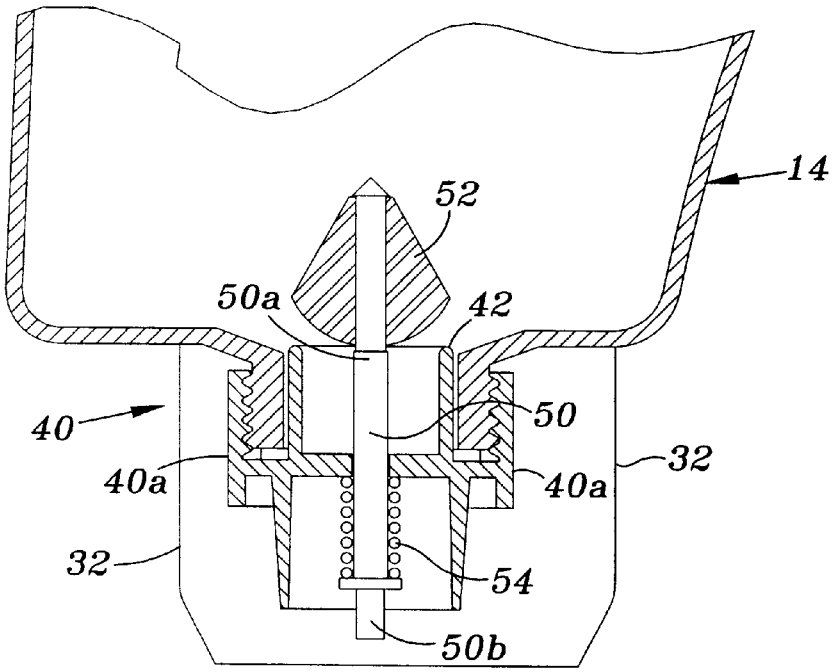
FIG. 5 is a sectional view of the present reservoir valve in the open position.

Referring now to FIGS. 4 and 5, reservoir valve 40 includes a stem 50 having ends 50*a* and 50*b*. Attached to end 50*a* of stem 50 is a plunger 52 which is disposed within aperture 42. Disposed around stem 50 is a spring 54 which positions plunger 52 to seal aperture 42 in the valve closed position. The tension of spring 54 normally retains plunger 52 within aperture 42. Pressure exerted on end 50*b* of stem 50 causes spring 54 to compress, thereby allowing plunger 52 to move upwardly within reservoir 14 thereby opening aperture 42 to allow water to flow outwardly of reservoir 14. FIG. 4 illustrates valve 40 in the closed position with plunger 52 closing aperture 42. FIG. 5 illustrates valve 40 in the open position in which plunger 52 is disposed completely within reservoir 14 to open aperture 42.

Figure 6:
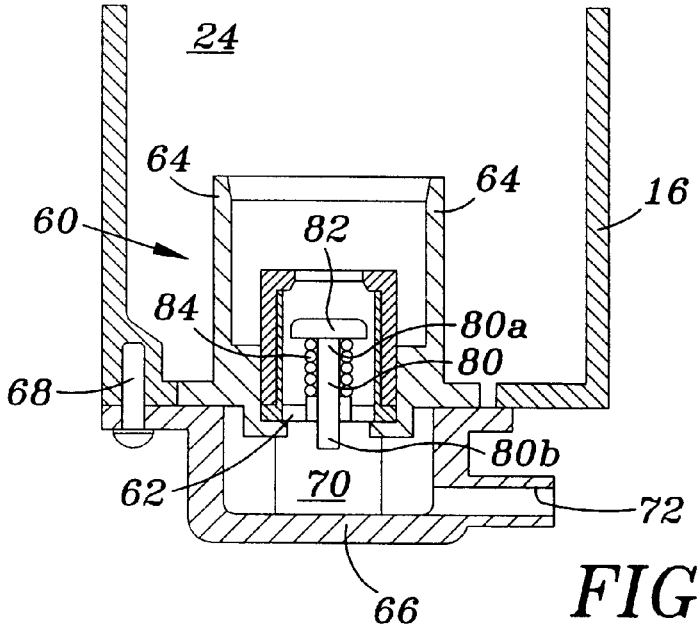
FIG. 6 is a sectional view of the present base valve in the open position.
Figure 7:
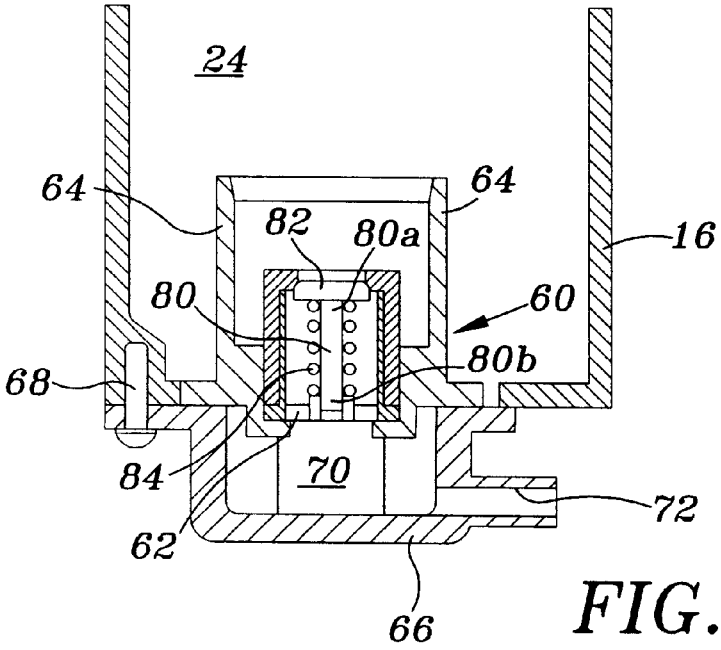
FIG. 7 is a sectional view of the present base valve in the closed position.

Referring simultaneously to FIGS. 2, 6, and 7, base 16 of stand 12 includes a base valve, generally identified by the numeral 60. Base valve 60 is operable between an open position as illustrated in FIG. 6 and a closed position as illustrated in FIG. 7. Base valve 60 is normally closed, and is moved to the open position when reservoir 14 initially engages holder 24 of base 12. When open, base valve 60 allows fluids to flow from reservoir 14 into receptacle 18. Base valve 60 is disposed within an aperture 62 within base 16. A seal 64 surrounds base valve 60 and is disposed within aperture 62 to prevent water from leaking from base 16. Mounted below seal 64 is an elbow holder 66. Elbow holder 66 is secured to base 16 utilizing fasteners 68. Elbow holder 66 includes a fluid inlet aperture 70 and a fluid outlet aperture 72. Water passes through base valve 60 in the open position into fluid inlet aperture 70 and exits elbow holder 66 via a fluid exit aperture 72. Elbow holder 66 is attached to a flexible tube 76 having ends 76*a* and 76*b*. Tube 76 is in fluid communication with fluid exit aperture 72 of elbow holder 66 at end 76*a*. End 76*b* of flexible tube 76 is disposed within receptacle 18 of base 16 to thereby provide a fluid communication path between base valve 60 and receptacle 18.

As more clearly shown in FIGS. 6 and 7, base valve 60 includes a stem 80 having ends 80*a* and 80*b*. A plunger 82 is attached to end 80*a* and functions to close aperture 62 in the base valve 60 closed position illustrated in FIG. 7. Disposed around stem 80 of base valve 60 is a spring 84 which normally biases plunger 82 in the closed position. When spring 84 is compressed, by moving stem 80 downwardly toward holder 66, as illustrated in FIG. 6, plunger 82 is positioned closer to aperture 62 which will thereby open aperture 62.

Figure 8:
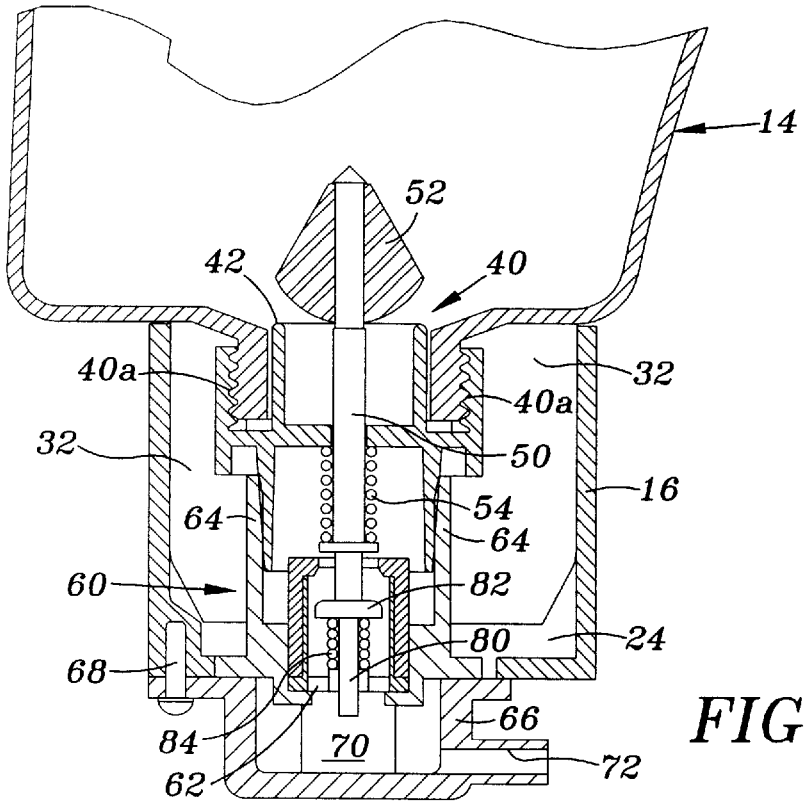
FIG. 8 is a sectional view of the present receptacle valve and base valve in the open position.
Figure 9:
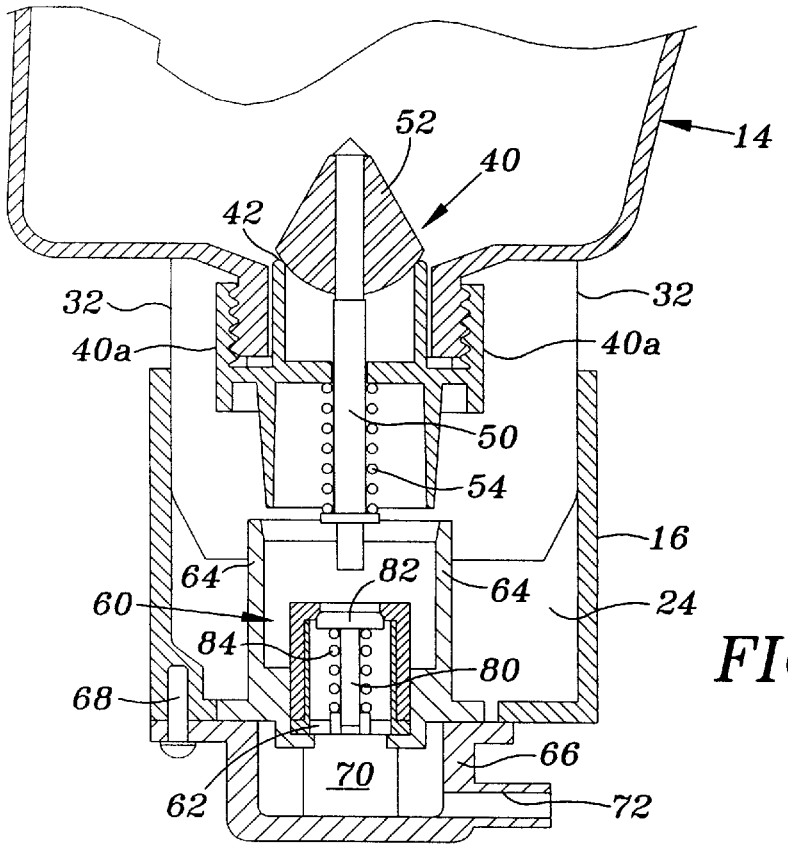
FIG. 9 is a sectional view of the present receptacle valve and base valve in the closed position.

Referring simultaneously to FIGS. 8 and 9, when reservoir 14 is inserted within holder 24 of base 16, stem 50 of valve 40 aligns with stem 80 of valve 60. The downwardly directed force exerted by stem 50 on stem 80 causes stem 80 to compress spring 84 thereby allowing plunger 82 to move downwardly and open aperture 62 within base 16. The continued insertion of reservoir 14 within holder 24 once valve 60 is open, causes stem 80 to exert an upwardly directed force on stem 50 thereby compressing spring 54 and causing plunger 52 to move inwardly into reservoir 14 to open aperture 42. Valve 40 opens after valve 60 has been opened to thereby insure that a fluid path for water from reservoir 14 will flow into receptacle 18. As illustrated in FIG. 8, in the open position of both valves 40 and 60, springs 54 and 84 are compressed, and a fluid path exists between reservoir 14 and elbow holder 66. In the closed position as illustrated in FIG. 9, both springs 54 and 84 are expanded to their normal position and valves 40 and 60 are closed to prevent fluid from flowing from reservoir 14 into elbow holder 66.

The flow of fluid from reservoir 14 into receptacle 18 is automatic, via gravity. The amount of fluid transferred from reservoir 14 to receptacle 18 depends on the relative fluid heights of reservoir 14 and receptacle 18. Since reservoir 14 and receptacle 18 are exposed to atmospheric pressure, the level of water within receptacle 18 will rise to the level of fluid within reservoir 14, and therefore fluid cannot overflow from receptacle 18. When reservoir 14 is removed from holder 24, both valves 40 and 60 close (FIG. 9). No water will flow out of receptacle 18 through valve 60, and no water will flow out of reservoir 14.

It therefore can be seen that the present invention provides for a tree support with a liquid reservoir for continuously and conveniently providing a source of water to a tree trunk and which prevents spillage of water from both the tree support and reservoir.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A tree stand for supporting a tree having a trunk, the stand comprising:

a base;

said base including a receptacle for receiving and supporting the tree trunk;

a fluid reservoir for storing a fluid, said reservoir being detachably connected to said base;

a first valve attached to said fluid reservoir and being operable in an open position to allow fluid to flow outwardly of said fluid reservoir and a closed position to prevent fluid from flowing outwardly of said fluid reservoir;

a second valve attached to said base and in fluid communication with said receptacle, said second valve being operable in an open position to allow fluid to flow into said receptacle and a closed position to prevent fluid from flowing outwardly of said receptacle; and said first and second valves being disposed such that when said fluid reservoir is attached to said base, said first valve engages said second valve to thereby cause the first valve to move from said closed position to said open position and said second valve to move from said closed position to said open position to allow fluid to flow from said fluid reservoir into said receptacle.

2. The stand of claim 1 wherein said first valve engages said second valve such that said second valve moves to said open position prior to said first valve moving to said open position.

3. The tree stand of claim 1 wherein said fluid reservoir includes a vented fill cap.

4. The tree stand of claim 1 wherein said fluid reservoir includes a pair of feet for engaging said base.

5. The tree stand of claim 1 wherein said base further includes an elbow holder in fluid communication with said second valve and a flexible tube providing fluid communication between said elbow holder and said receptacle within said base.

* * * * *